US012448804B2

(12) United States Patent
Seo

(10) Patent No.: US 12,448,804 B2
(45) Date of Patent: Oct. 21, 2025

(54) TENSILE TRANSMISSION TOWER DESIGN

(71) Applicant: SEOUL NATIONAL UNIVERSITY R&DB FOUNDATION, Seoul (KR)

(72) Inventor: Hyun Seo, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 222 days.

(21) Appl. No.: 18/258,772

(22) PCT Filed: Dec. 2, 2021

(86) PCT No.: PCT/KR2021/018124
§ 371 (c)(1),
(2) Date: Jun. 21, 2023

(87) PCT Pub. No.: WO2022/145765
PCT Pub. Date: Jul. 7, 2022

(65) Prior Publication Data

US 2024/0044166 A1 Feb. 8, 2024

(30) Foreign Application Priority Data

Dec. 30, 2020 (KR) ..... 10-2020-0187846

(51) Int. Cl.
*E04H 12/10* (2006.01)
*E04H 12/20* (2006.01)
*E04H 12/24* (2006.01)

(52) U.S. Cl.
CPC ..... *E04H 12/10* (2013.01); *E04H 12/20* (2013.01); *E04H 12/24* (2013.01)

(58) Field of Classification Search
CPC ..... E04H 12/10; E04H 12/12; E04H 12/20; E04H 12/24
See application file for complete search history.

(56) References Cited

U.S. PATENT DOCUMENTS 1,584,691 A * 5/1926 Bowman ..... E04H 12/10 52/693
1,741,963 A * 12/1929 Thomas ..... E04H 12/10 174/43

(Continued)

FOREIGN PATENT DOCUMENTS

CN 105756401 A * 7/2016
CN 105888353 A * 8/2016 ..... E04H 12/08

(Continued)

OTHER PUBLICATIONS

International Search Report for PCT/KR2021/018124 by Korean Intellectual Property Office dated Mar. 31, 2022.

*Primary Examiner* — Jessie T Fonseca
(74) *Attorney, Agent, or Firm* — BROADVIEW IP LAW, PC

(57) ABSTRACT

Disclosed in the present invention is a transmission tower comprising: a mast part erected on the ground; one or more arm members, which are provided vertically with respect to the longitudinal direction of the mast part to hold transmission lines; at least one buckling-prevention member holding part provided in the longitudinal direction of the mast part; a plurality of buckling-prevention members, which pass through the buckling-prevention member holding part from the lower end of the mast part so as to be provided at the upper end of the mast part, and thus prevent buckling of the mast part; and a plurality of oblique members, which are secured to the ground while forming a predetermined inclination from the mast part, and thus prevent overturning of the mast part.

10 Claims, 11 Drawing Sheets

(56) References Cited

U.S. PATENT DOCUMENTS

| | | | | | |
|---|---|---|---|---|---|
| 2,683,615 | A * | 7/1954 | Holt | H01Q 1/1235 | 248/354.4 |
| 3,110,368 | A * | 11/1963 | Ross | H01Q 1/1242 | 52/223.4 |
| 3,504,464 | A * | 4/1970 | Bair | E04H 12/20 | 174/45 R |
| 4,106,244 | A | 8/1978 | Kessler et al. | | |
| 9,416,555 | B2 * | 8/2016 | De Abreu | E04H 12/20 | |
| 2017/0114565 | A1 * | 4/2017 | Lindsey | B64D 1/22 | |
| 2019/0292804 | A1 * | 9/2019 | Kensinger | E04H 12/20 | |

FOREIGN PATENT DOCUMENTS

| | | | | | |
|---|---|---|---|---|---|
| CN | 110005576 | A | * | 7/2019 | E04G 21/1841 |
| CN | 113898236 | A | * | 1/2022 | E04G 23/0218 |
| EP | 3521535 | A1 | | 8/2019 | |
| JP | 2004-245042 | A | | 9/2004 | |
| KR | 10-2002-0024982 | A | | 4/2002 | |
| KR | 10-2014-0140838 | A | | 12/2014 | |
| KR | 10-2020-0013330 | A | | 2/2020 | |

* cited by examiner

TENSILE TRANSMISSION TOWER DESIGN

CROSS-REFERENCE TO RELATED APPLICATIONS

This application is a National Phase Entry Application of PCT Application No. PCT/KR2021/018124, filed on Dec. 2, 2021, which claims priority to Korean Patent Application No. 10-2020-0187846, filed on Dec. 30, 2020, in Korean Intellectual Property Office, the entire contents of which are hereby incorporated by reference in its entirety.

TECHNICAL FIELD

The present disclosure relates to a tensile transmission tower design having an improved structure and, more particularly, to a transmission tower, wherein compression members and tension members are separated, the tension members are increased, thereby improving buckling-related characteristics, and necessary members are minimized, thereby improving assembly-related convenience and economic merits.

BACKGROUND ART

In general, the process in which electric power generated at power plants or the like is transmitted to remotely located factories, buildings, houses, or the like is referred to as power transmission, and transmission towers are widely used as facilities for supporting transmission lines, such as power lines, for such power transmission.

A conventional transmission tower, as illustrated in FIG. 1, is configured as a truss iron-frame structure in which four poles are cross-connected by multiple members so as to stably support transmission lines against natural disasters such as typhoons or earthquakes.

However, such a conventional transmission tower structure, which has been used for nearly a century, has a large structure section loss because both a tensile force and a compressive force are applied thereto in that shape, and a member loss may occur because an external force, if applied, is not evenly distributed, and the resulting tensile force or compressive force is concentrated on a specific member.

Particularly, such a conventional iron-frame structure is vulnerable to compressive buckling and accidental eccentricity. If a member undergoes buckling due to a typhoon, a strong wind, or the like, a continuous member loss may occur. This requires continuous and precise management regarding member twisting or the like in a difficult manner.

Meanwhile, conventional approaches for solving the above-mentioned problems include replacing a member with one having a large section, and installing an additional reinforcement member. However, such approaches still have a problem in that excessive members, costs, and operation hours are necessary to install, maintain, and repair the transmission tower.

DISCLOSURE OF INVENTION

Technical Problem

The present disclosure has been made to solve the above-mentioned problems occurring in the prior art, and it is an aspect of the present disclosure to provide a tensile transmission tower capable of effectively solving problems of conventional transmission towers in that excessive members, costs, and operation hours are necessary to install, maintain, and repair the transmission towers because a tensile force and a compressive force are applied thereto in conventional shapes, thereby causing a large structure section loss, an external force applied thereto, if concentrated on a specific member without being distributed, may cause a member loss, and if a member undergoes buckling, a continuous member loss may occur.

Other detailed aspects of the present disclosure will be obviously recognized and understood from the following detailed descriptions by experts or researchers in the pertinent technical field.

Solution to Problem

In order to solve the above-mentioned problems, a transmission tower according to an aspect of the present disclosure may include: a mast portion erected on the ground; at least one arm member provided perpendicularly to the longitudinal direction of the mast portion so as to cradle a transmission line; one or at least two buckling prevention member cradling portions provided along the longitudinal direction of the mast portion; and multiple buckling prevention members provided to extend from the lower end of the mast portion to the upper end of the mast portion via the buckling prevention member cradling portions so as to prevent the mast portion from buckling.

The transmission tower may further include an arm member connecting portion configured to connect the buckling prevention member cradling portion and the arm member.

The arm member connecting portion may include an upper arm member connecting portion configured to connect a buckling prevention member cradling portion positioned above the arm member and the arm member, and a lower arm member connecting portion configured to connect a buckling prevention member cradling portion positioned below the arm member and the arm member.

In addition, the arm member connecting portion may include multiple wire rods connected from the arm member to the buckling prevention member cradling portion in symmetric shapes while having a predetermined inclination with regard to each other.

In addition, the multiple buckling prevention members may be connected from the lower end of the mast portion to the upper end of the mast portion at an identical interval with regard to each other.

In addition, the buckling prevention members may further include a second buckling prevention member connected from the buckling prevention member cradling portion to the mast portion while having a predetermined inclination.

In addition, the buckling prevention member cradling portions may include a first buckling prevention member cradling portion positioned close to the arm member within a predetermined distance therefrom and fixed to the mast portion in a circular shape, and a second buckling prevention member cradling portion positioned to be spaced apart from the arm member by at least a predetermined distance therefrom and fixed to the mast portion in a linear shape.

In addition, the transmission tower may further include multiple diagonal tension members fixed to the ground from the mast portion while having a predetermined inclination so as to prevent the mast portion from falling.

The multiple diagonal tension members may be fixed to the ground from the mast portion at an identical interval with each other.

Furthermore, each of the diagonal tension members may include multiple wire rods having a predetermined angle with each other.

Advantageous Effects of Invention

A tensile transmission tower according to an embodiment of the present disclosure is advantageous in that the same is capable of effectively solving problems of conventional transmission towers in that excessive members, costs, and operation hours are necessary to install, maintain, and repair the transmission towers because a tensile force and a compressive force are applied thereto in conventional shapes, thereby causing a large structure section loss, an external force applied thereto, if concentrated on a specific member without being distributed, may cause a member loss, and if a member undergoes buckling, a continuous member loss may occur.

BRIEF DESCRIPTION OF DRAWINGS

The accompanying drawings, which are included as part of the detailed description to help understanding of the present disclosure, provide embodiments of the present disclosure and describe the technical idea of the present disclosure together with the detailed description.

BEST MODE FOR CARRYING OUT THE INVENTION

The present disclosure may be variously modified and may have various embodiments, and specific embodiments thereof will now be described in detail with reference to the accompanying drawings.

Embodiments are provided hereinafter to help comprehensive understanding of methods, devices, and/or systems described in the present disclosure. However, they are only examples, and the present disclosure is not limited thereto.

In the following description of embodiments of the present disclosure, detailed descriptions of known arts related to the present disclosure will be omitted if deemed to unnecessarily obscure the gist of the present disclosure. In addition, terms used herein are defined in view of functions in the present disclosure, and may vary depending on the intent, practice, and the like of users or operators. Therefore, the definitions are to be made in view of the overall context of the present disclosure. Terms used in the detailed description are only for describing embodiments of the present disclosure, and are not to be limited in any manner. An expression in a singular form includes a meaning in a plural form unless otherwise specified. Expressions such as "include" or "have" used herein are intended to denote specific characteristics, numbers, steps, operations, elements, a part thereof, or a combination thereof, and are not to be interpreted as excluding the existence or possibility of one or more other characteristics, numbers, steps, operations, elements, a part thereof, or a combination thereof in addition to those described.

Furthermore, terms such as "first" and "second" may be used to describe various embodiments, but the components are not limited by such terms, and the terms are used only to identify one component from others.

Hereinafter, exemplary embodiments of a transmission tower 100 having an improved structure according to an embodiment of the present disclosure will be described in detail with reference to the accompanying drawings.

Figure 1:
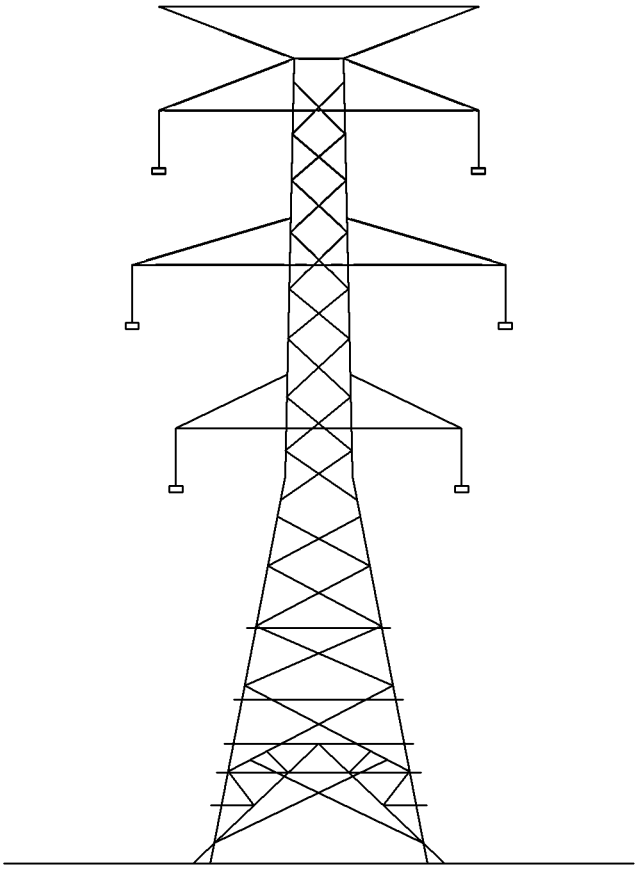
FIG. 1 illustrates a transmission tower according to the prior art.
Figure 2:
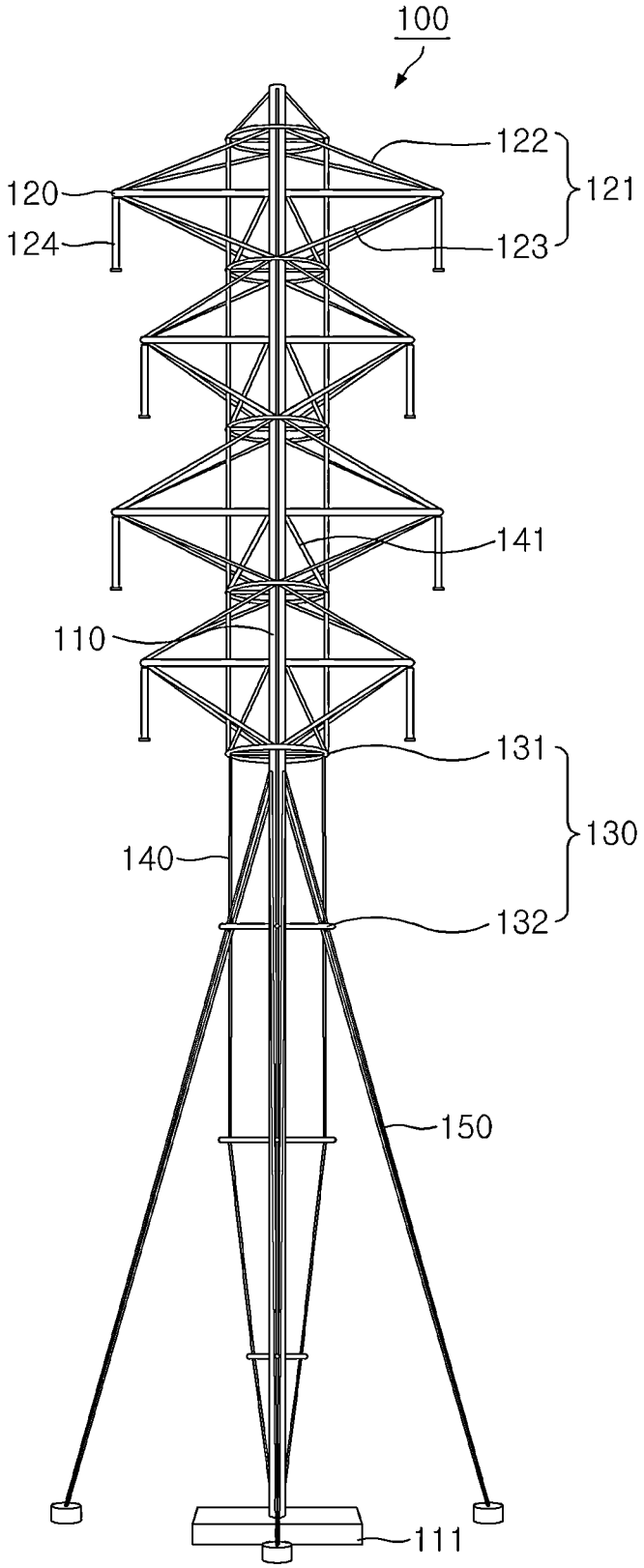
FIG. 2 illustrates a transmission tower according to an embodiment of the present disclosure.

FIG. 2 illustrates a transmission tower 100 having an improved structure according to an embodiment of the present disclosure. As illustrated in FIG. 2, the transmission tower 100 having an improved structure according to an embodiment of the present disclosure may include a mast portion 110 erected on the ground, at least one arm member 120 provided perpendicularly to the longitudinal direction of the mast portion 110 so as to cradle a transmission line, one or at least two buckling prevention member cradling portions 130 provided along the longitudinal direction of the mast portion 110, and multiple buckling prevention members 140 provided to extend from the lower end of the mast portion 110 to the upper end of the mast portion 110 via the buckling prevention member cradling portions 130, thereby preventing the mast portion 110 from buckling.

The transmission tower 110 having an improved structure according to an embodiment of the present disclosure may further include an arm member connecting portion 121 configured to connect the buckling prevention member cradling portions 130 and the arm member 120.

In addition, the transmission tower 100 having an improved structure according to an embodiment of the present disclosure may further include multiple diagonal tension members 150 fixed to the ground at a predetermined inclination with regard to the mast portion 110, thereby preventing the mast portion 110 from falling.

Accordingly, the transmission tower 100 according to an embodiment of the present disclosure is capable of effectively solving problems of conventional transmission towers in that excessive members, costs, and operation hours are necessary to install, maintain, and repair the transmission towers because a tensile force and a compressive force are applied thereto in conventional shapes, thereby causing a large structure section loss, an external force applied thereto, if concentrated on a specific member without being distributed, may cause a member loss, and if a member undergoes buckling, a continuous member loss may occur.

Hereinafter, respective components of the transmission tower 100 having an improved structure according to an embodiment of the present disclosure will be described in detail with reference to FIG. 2.

The mast portion 110 is erected on the ground, as illustrated in FIG. 2, and functions as the basic structure of the transmission tower 100.

The mast portion 110 may be made of iron, but the present disclosure is not necessarily limited thereto. The mast portion 110 may be made of other metals or alloys, and may also be made of a nonmetal material.

In addition, the mast portion 110 may have a circular sectional shape, but the present disclosure is not necessarily limited thereto. In addition, the mast portion 110 may have an elliptical or polygonal shape. It is also possible to the configure the mast portion 110 in a pipe shape or by using multiple iron wire rod bundles.

In addition, as illustrated in FIG. 2, the mast portion 110 has a mast seating portion 111 provided below the mast portion 110 so as to provide a structure in which the mast portion 110 is stably erected on the ground.

The mast seating portion 111 may be made of a quadrangular iron plate, but the present disclosure is not necessarily limited thereto. The mast seating portion 111 may have various shapes, such as a circle, an ellipse, and a polygon, and may be made of various materials, such as a metal, an alloy, and a nonmetal material.

The arm member 120 is provided perpendicularly to the longitudinal direction of the mast portion 110 so as to cradle a transmission line.

Figure 3:
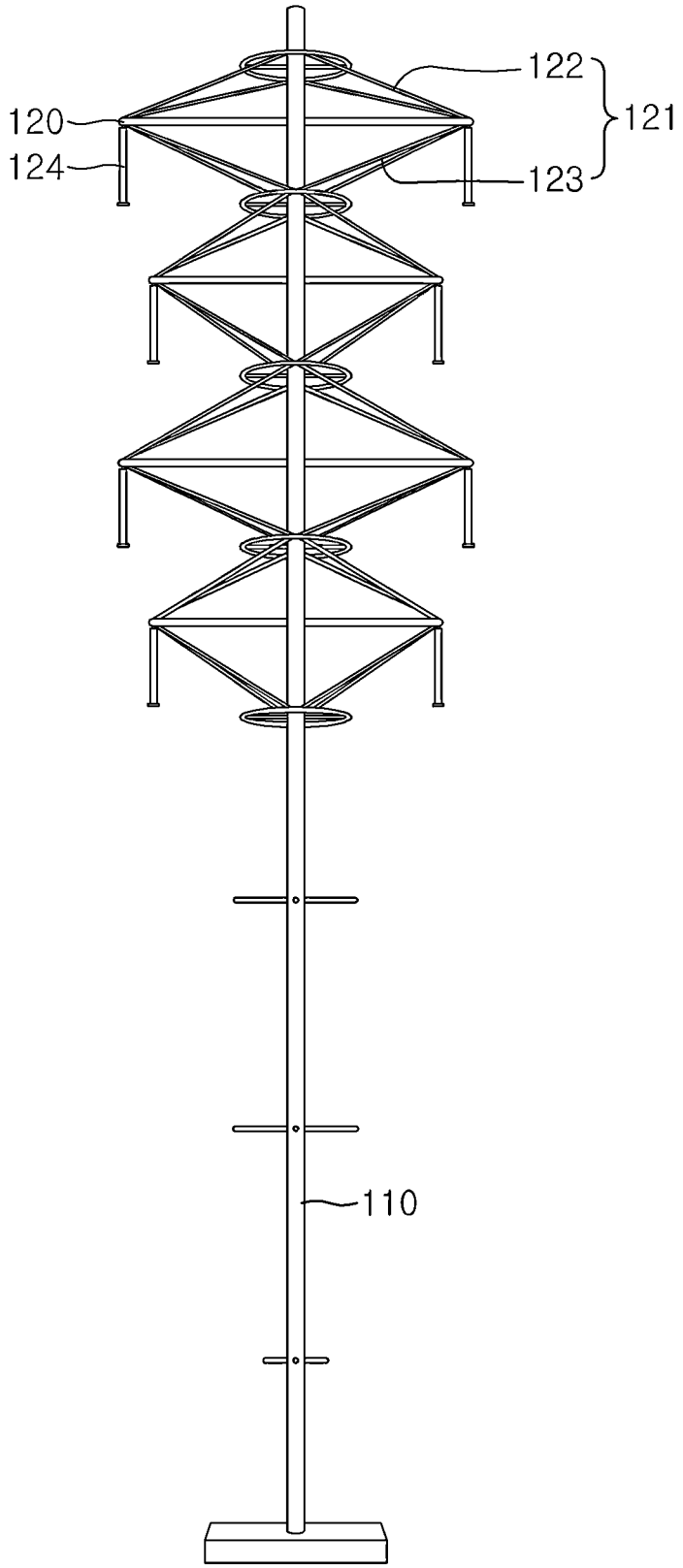
FIG. 3 illustrates an arm member of a transmission tower according to an embodiment of the present disclosure.

More specifically, as illustrated in FIG. 3, multiple arm members 120 may be provided at a predetermined interval in the longitudinal direction of the mast portion 110.

The arm member 120 may be configured using a wire rod made of a metal (for example, iron), but the present disclosure is not necessarily limited thereto. The arm member 120 may be made of a nonmetal material or configured in various shapes (for example, a board).

In addition, the arm member 120 may have at least one insulating member 124 (for example, an insulator) so as to insulate the arm member 120 from a transmission line.

In addition, the arm member 120 may have an arm member connecting portion 121 provided to connect the arm member 120 and the buckling prevention member cradling portion 130.

The arm member connecting portion 121 may include an upper arm member connecting portion 122 configured to connect the arm member 120 and a buckling prevention member cradling portion 130 positioned above the arm member 120 and a lower arm member connecting portion 123 configured to connect the arm member 120 and another buckling prevention member cradling portion 130 positioned below the arm member 120.

In addition, the arm member connecting portion 121 may include multiple wire rods connected from the arm member 120 to the buckling prevention member cradling portions 130 in symmetric shapes while having a predetermined inclination with regard to each other.

More specifically, as illustrated in FIG. 3, the upper arm member connecting portion 122 and the lower arm member connecting portion 123 may be made of wire rods configured in symmetric shapes while having a predetermined inclination with regard to each other, and connected to buckling prevention member cradling portions 130 positioned above and below the same, respectively.

Figure 4:
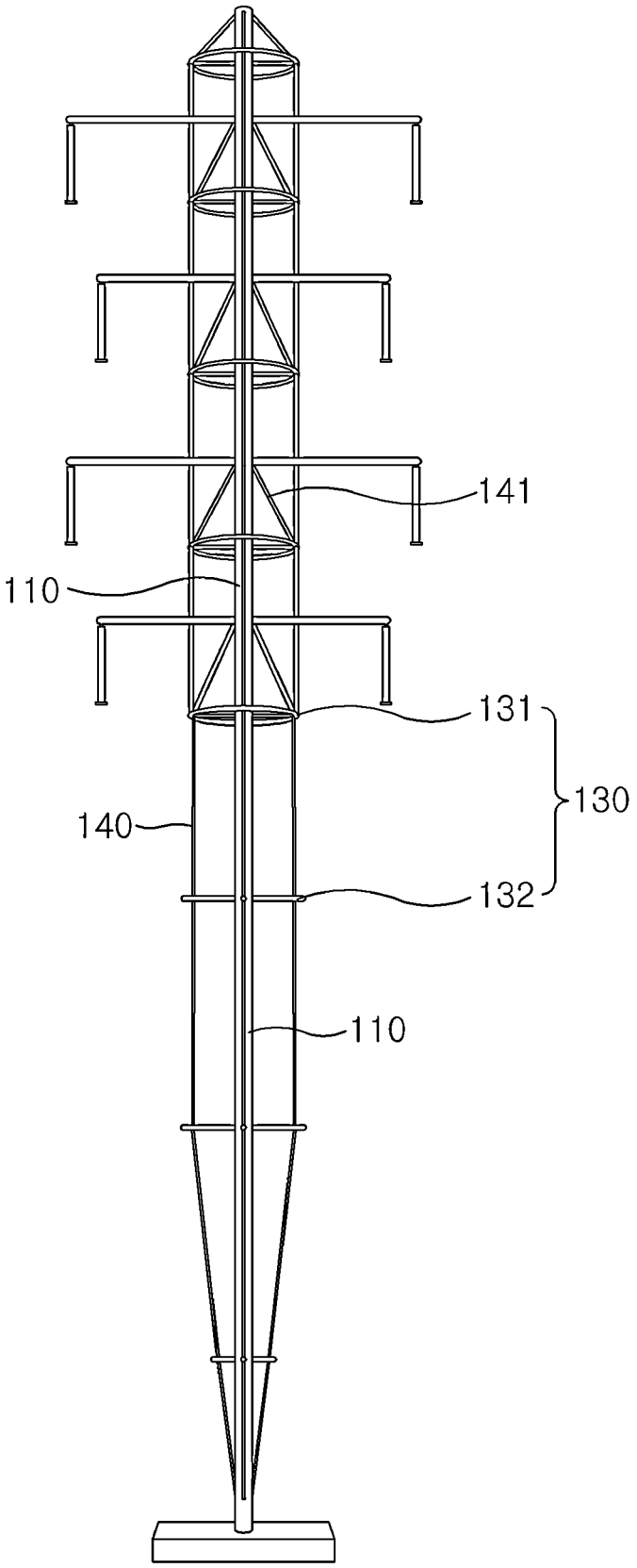
FIG. 4 illustrates a buckling prevention member and a buckling prevention member cradling portion of a transmission tower according to an embodiment of the present disclosure.

Next, as illustrated in FIG. 4, the mast portion 110 may have one or at least two buckling prevention member cradling portions 130 provided along the longitudinal direction.

Accordingly, multiple buckling prevention members 140 are provided to extend from the lower end of the mast portion 110 to the upper end of the mast portion 110 via the buckling prevention member cradling portions 130, thereby preventing the mast portion 110 from buckling.

The buckling prevention members 140 may be configured using wire rods made of a metal (for example, iron), but the present disclosure is not necessarily limited thereto. The buckling prevention members 140 may be made of a nonmetal material and may be implemented in various manners (for example, by twisting multiple wires).

In addition, multiple buckling prevention members 140 may be provided to extend from the lower end of the mast portion 110 to the upper end of the mast portion 110 via the buckling prevention member cradling portions 130, while having the same interval from each other, such that the tensile force applied to the mast portion 110 is evenly distributed across the multiple buckling prevention members 140, thereby preventing the mast portion 110 from buckling more effectively.

As a more specific example, FIG. 4 illustrates a case in which four buckling prevention members 140 are provided and disposed at an interval of 90° with regard to each other.

However, the present disclosure is not necessarily limited thereto, and the buckling prevention members 140 may be disposed in various manners (for example, three buckling prevention members 140 are disposed at an interval of 120°, or five buckling prevention members 140 are disposed at an interval of 72°).

In addition, in the present disclosure, the buckling prevention member 140 may further include a second buckling prevention member 141 connected from the buckling prevention member cradling portion 130 to the mast portion 110 at a predetermined inclination, as illustrated in FIG. 4, such that the buckling prevention member 140 can prevent the mast portion 110 from buckling more effectively.

In addition, as illustrated in FIG. 4, the buckling prevention member cradling portion 130 may further include a first buckling prevention member cradling portion 131 positioned close to the arm member 120 within a predetermined distance therefrom and fixed to the mast portion 110 in a circular shape, and a second buckling prevention member cradling portion 132 positioned to be spaced apart from the arm member 120 by at least a predetermined distance and fixed to the mast portion 110 in a linear shape.

More specifically, the first buckling prevention member cradling portion 131 may be made of a metal (for example, iron) and configured by a circular structure having a predetermined radius around the mast portion 110, as illustrated in FIG. 4, but the present disclosure is not necessarily limited thereto. The first buckling prevention member cradling portion 131 may also be made of a nonmetal material or configured in a polygonal shape or the like.

In addition, the second buckling prevention member cradling portion 132 may include wire rods made of a metal (for example, iron) and fixed to the mast portion 110 at an identical interval, as illustrated in FIG. 4, but the present disclosure is not necessarily limited thereto. The second buckling prevention member cradling portion 132 may also be made of a nonmetal material or configured in a circular shape, a polygonal shape or the like.

Therefore, multiple buckling prevention members 140 may extend from the lower end of the mast portion 110 to the upper end of the mast portion 110 via the second buckling prevention member cradling portion 132 and the first buckling prevention member cradling portion 131 at an identical interval from each other.

Accordingly, the transmission tower 100 having an improved structure according to the present disclosure may have compression members and tension members disposed separately, may have increased tension members, thereby having increased resistance to buckling caused by a damage to members, and may reduce members, costs, and operation hours necessary to install, maintain, and repair the transmission tower, unlike conventional transmission towers having iron-frame structures to which a tensile force and a compressive force are simultaneously applied.

In addition, the transmission tower 100 having an improved structure according to an embodiment of the present disclosure may include multiple diagonal tension members 150 fixed to the ground at a predetermined inclination from the mast portion 110, thereby preventing the mast portion 110 from falling.

The diagonal tension members 150 may be configured using wire rods made of a metal (for example, iron), but the present disclosure is not necessarily limited thereto. The diagonal tension members 150 may be made of a nonmetal material and may be implemented in various manners (for example, by twisting multiple wires).

In addition, multiple diagonal tension members 150 may be fixed to the ground at the same interval from the mast portion 110, thereby preventing the mast portion 110 from falling more effectively.

Figure 5:
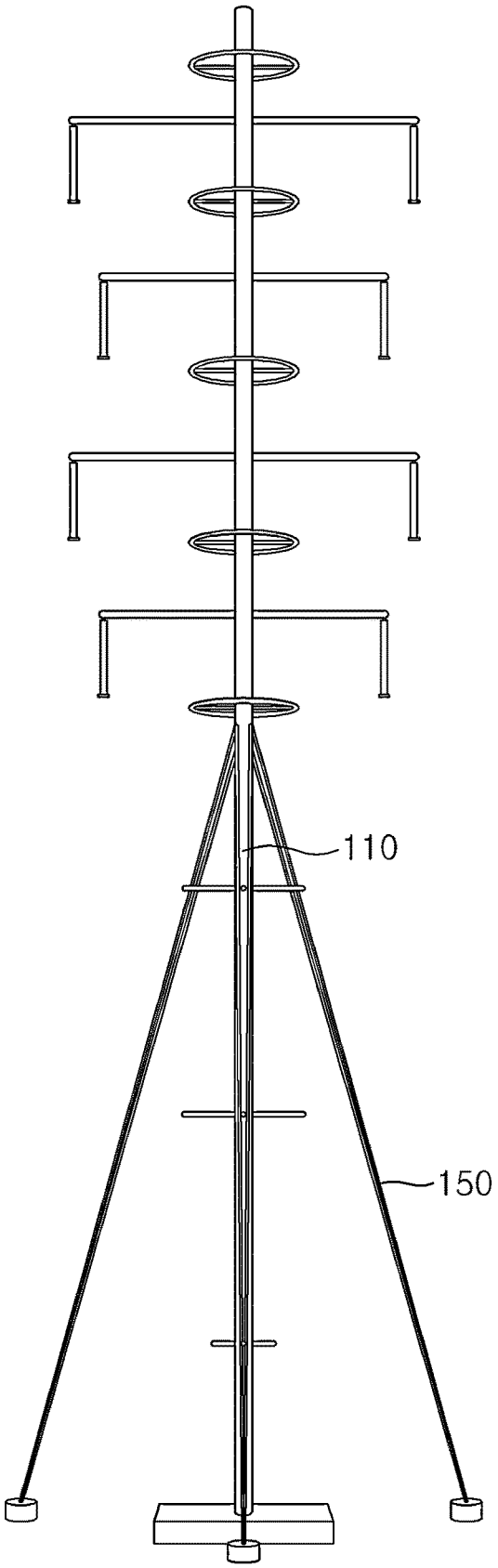
FIG. 5 illustrates a diagonal tension member of a transmission tower according to an embodiment of the present disclosure.

As a more specific example, FIG. 5 illustrates a case in which three diagonal tension members 150 are provided and disposed at an interval of 120° from each other.

However, the present disclosure is not necessarily limited thereto, and the diagonal tension members 150 may be disposed in various manners (for example, fourth diagonal tension members 150 are disposed at an interval of 90°, or five diagonal tension members 150 are disposed at an interval of 72°).

In addition, each diagonal tension member 150 may include multiple wire rods having a predetermined angle with each other.

As a more specific example, as illustrated in FIG. 5, each diagonal tension member 150 in the present disclosure may include multiple wire rods connected from the mast portion 110 to the ground while having a predetermined angle with each other, thereby preventing the mast portion 110 from falling more effectively.

Figure 6A:
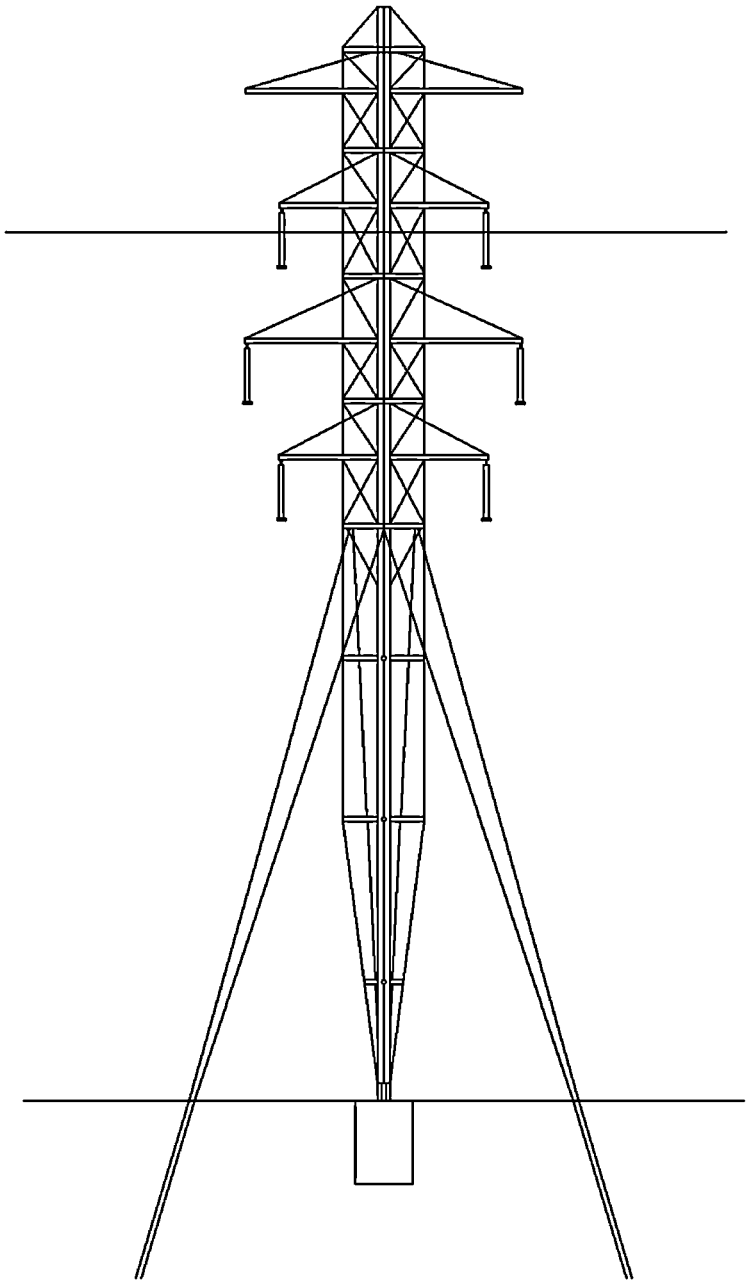
FIGS. 6A and 6B illustrate ground-based foundation structures of a transmission tower according to an embodiment of the present disclosure.
Figure 6B:
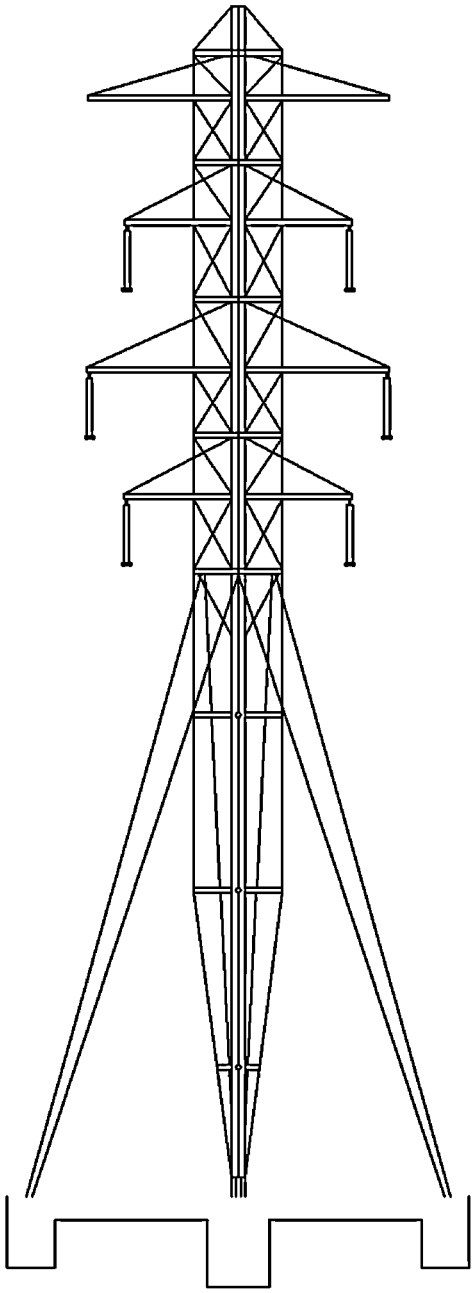

In addition, FIGS. 6A and 6B illustrate ground-based foundation structures of the transmission tower 100 according to an embodiment of the present disclosure.

More specifically, conventional transmission towers 100 have limitations in that foundation structures are all subjected to compressive forces, and foundation shapes need to constitute quadrangular points. According to the present disclosure, however, the mast portion 110 positioned at the center may be placed on a compressive foundation, three or multiple diagonal tension members 150 may be connected to an earth anchor, of if it is difficult to form the earth anchor, the three or multiple diagonal tension members 150 may all be connected and combined in a single foundation structure.

Moreover, the earth anchor type may be advantageous in that the foundation structure has fewer restrictions on position, and can be installed even on a sloping surface.

In addition, although structures in FIG. 2 to FIG. 6B have been described above, the present disclosure is not necessarily limited thereto, and a partial configuration of the transmission tower 100 according to an embodiment of the present disclosure may be modified or, in some environments, omitted.

Figure 7:
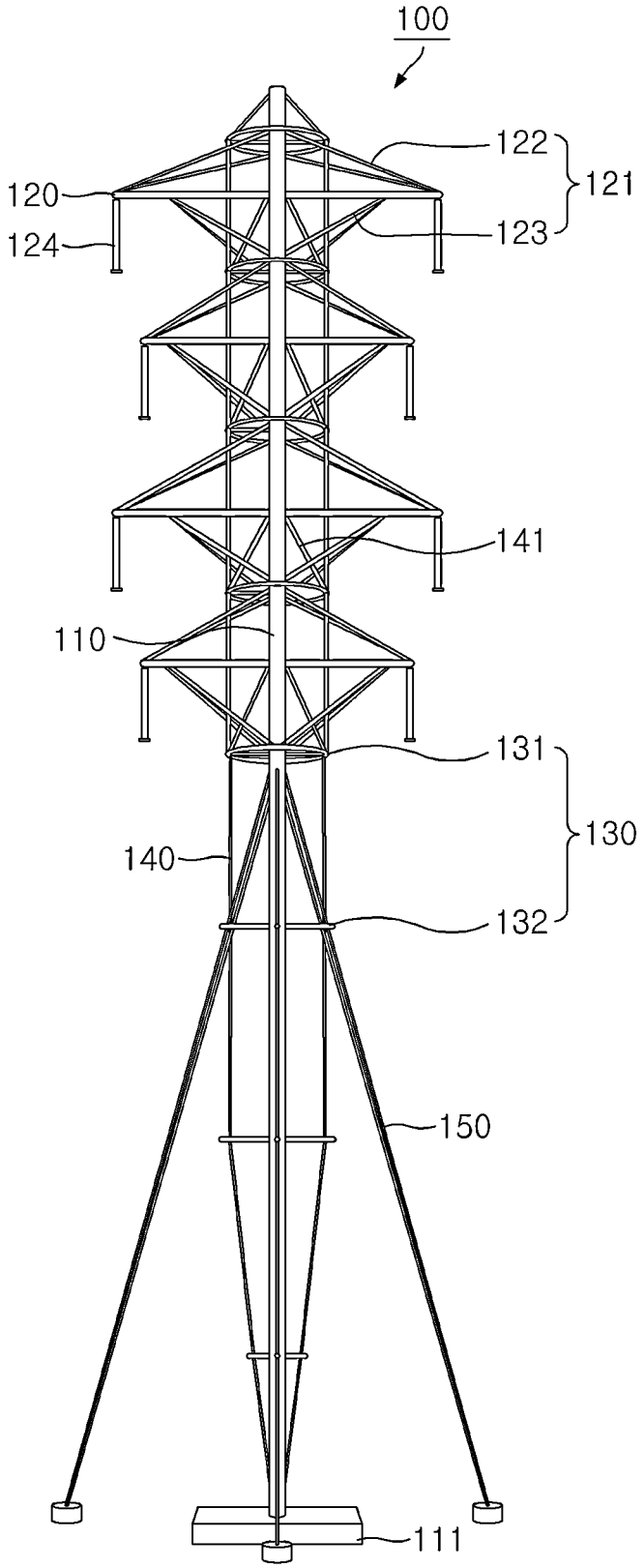
FIG. 7 illustrates a transmission tower according to another embodiment of the present disclosure.

As a more specific example, although the lower arm member connecting portion 123 is illustrated in FIG. 2 and FIG. 3 as being connected near an end of the arm member 120, the present disclosure is not necessarily limited thereto. The lower arm member connecting portion 123 may be connected near a middle portion of the arm member 120, as illustrated in FIG. 7, depending on the environment to which the same is applied.

MODE FOR CARRYING OUT THE INVENTION

Figure 8:
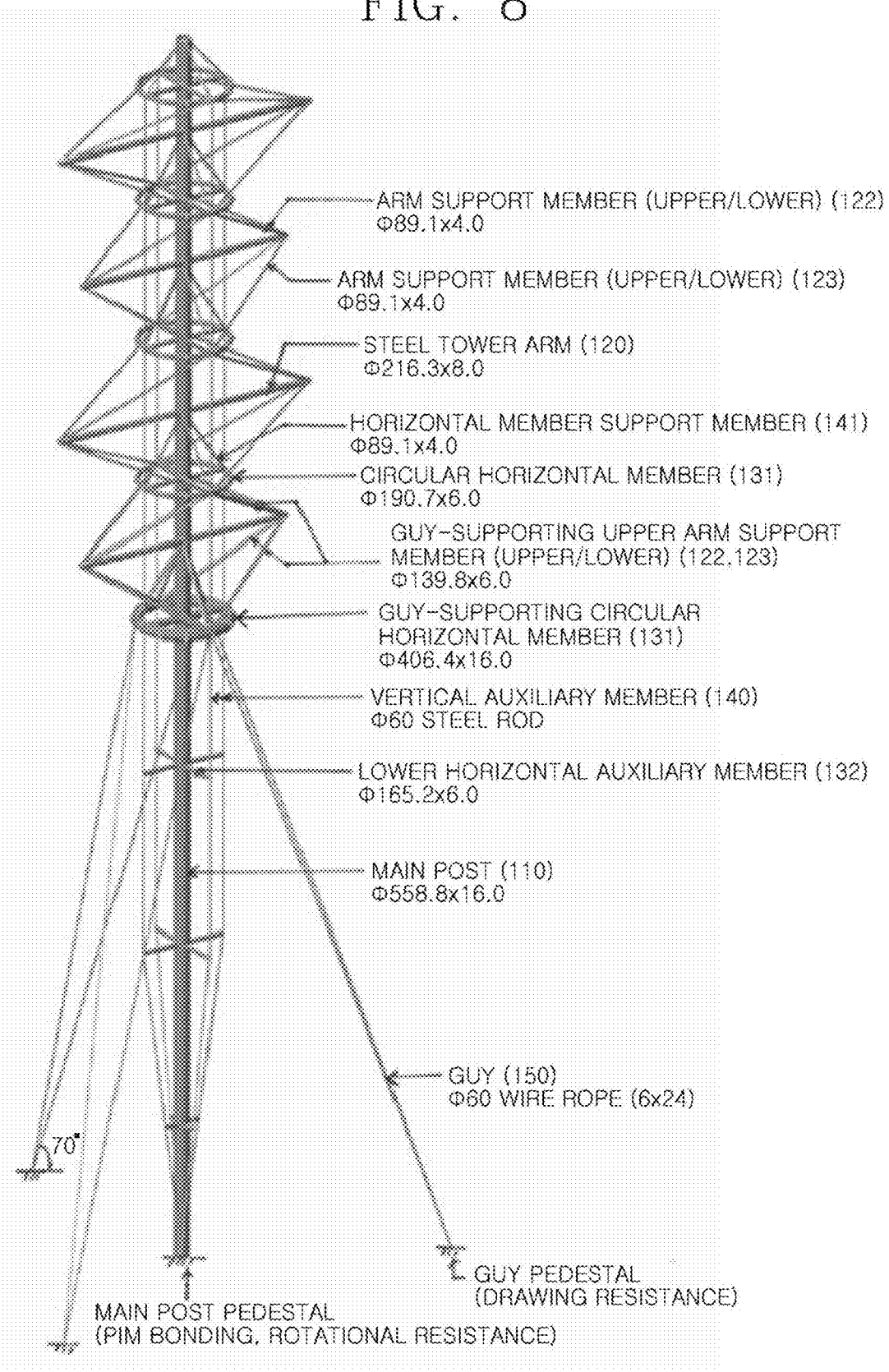
FIG. 8 illustrates the configuration and dimension of major members of a transmission tower according to an embodiment of the present disclosure.

In addition, FIG. 8 illustrates the structure of a transmission tower 100 according to an embodiment of the present disclosure, and the configuration and dimension of major members thereof.

However, the structure of the transmission tower 100 and the configuration and dimension of major members thereof, illustrated in FIG. 8, are exemplary, and the present disclosure is not limited thereto.

Furthermore, inventors of the present disclosure conducted structural analysis by using the structure of the transmission tower 100 and the configuration and dimension of major members thereof illustrated in FIG. 8, thereby verifying the assumed load on the transmission tower 100, member stress, and the like, and accordingly confirmed that the improved transmission tower 100 according to an embodiment of the present disclosure minimized necessary members, separated compression members and tension members, and increased tension members, thereby effectively improving buckling-related characteristics.

Figure 9:
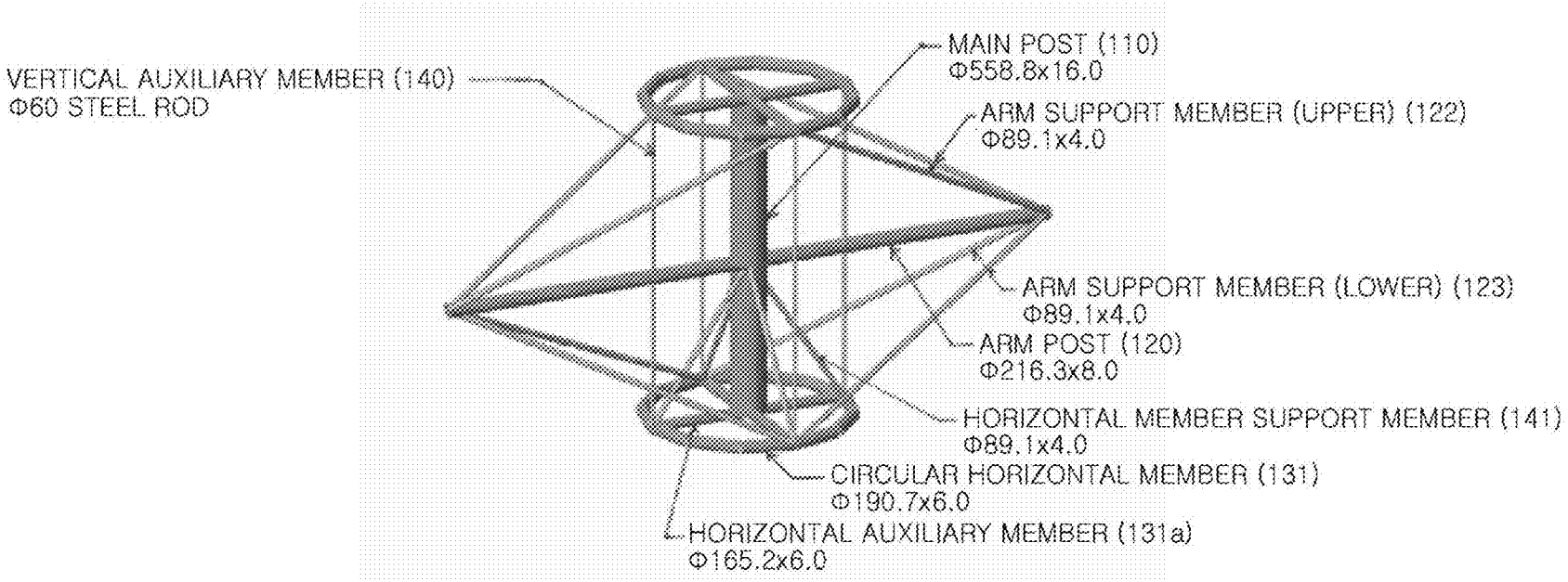
FIG. 9 illustrates a detailed connection structure of an arm member of a transmission tower according to an embodiment of the present disclosure.

More specifically, FIG. 9 illustrates a detailed connection structure of an arm member 120 of a transmission tower 100 according to an embodiment of the present disclosure.

As illustrated in FIG. 9, the transmission tower 100 according to an embodiment of the present disclosure may have an arm member 120 made of a single circular steel pipe, fixed to the mast portion 110, and reinforced by an upper arm member connecting portion 122 and a lower arm member connecting portion 123.

The strung wire imbalance tension and torsion may resist at the first buckling prevention member cradling portion 131 through the upper arm member connecting portion 122 and the lower arm member connecting portion 123 and the weak-axis rigidity of the arm member 120, and twisting of the first buckling prevention member cradling portion 131 may resist at the pedestal through the mist portion 110.

Furthermore, as illustrated in FIG. 9, the first buckling prevention member cradling portion 131 may be reinforced by a horizontal auxiliary member 131*a*.

Figure 10:
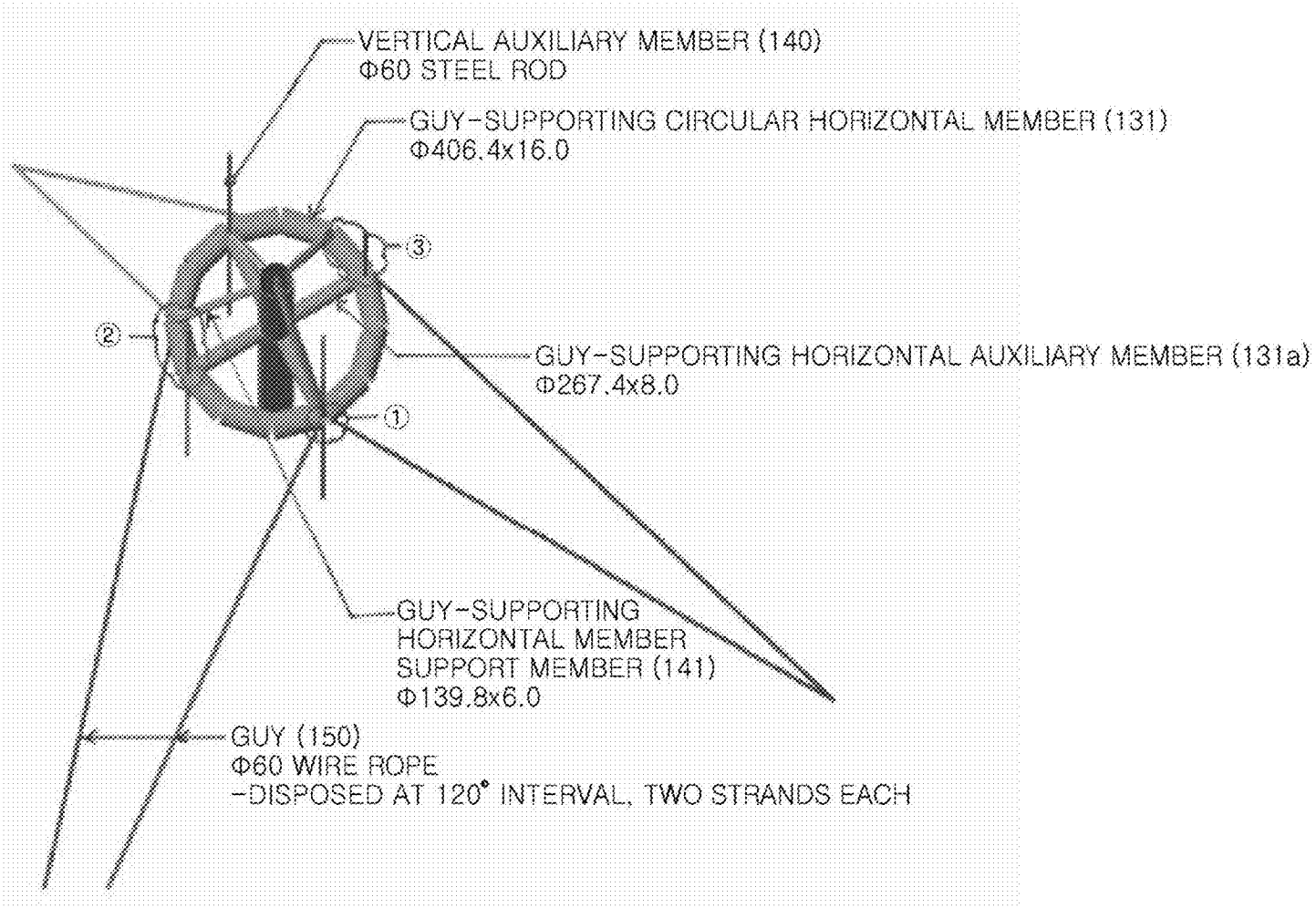
FIG. 10 illustrates a detailed connection structure of a diagonal tension member of a transmission tower according to an embodiment of the present disclosure.

In addition, FIG. 10 illustrates a detailed connection structure of a diagonal tension member 150 of a transmission tower 100 according to an embodiment of the present disclosure.

The transmission tower 100 according to an embodiment of the present disclosure resists the overall vertical load and twisting at the mast portion 110 positioned at the center, and the diagonal tension member 150 disposed at the mast portion 110 in three directions resists the horizontal load.

As illustrated in FIG. 10, the diagonal tension member 150 may form a connection structure with the first buckling prevention member cradling portion 131 connected to the mast portion 110.

In the transmission tower 100 according to an embodiment of the present disclosure, the tensile force of the diagonal tension member 150 may be transferred to the mast portion 110 through the second buckling prevention member 141 and the buckling prevention member 140 by using the first buckling prevention member cradling portion 131, to which the diagonal tension member 150 is connected, as an intermediate point.

In addition, as indicated by n in FIG. 10, the flow of load is good if the buckling prevention member 140 and the second buckling prevention member 141 connected to the diagonal tension member 150 have matching working points, but the size of the related member may increase if the working point of the three-direction diagonal tension member 150 and that of the four-direction second buckling prevention member 141 do not match.

In such a case, the problem may be exacerbated if the scale of the transmission tower 100 increases, and load is preferably transferred directly from the diagonal tension member 150 to the mast portion 110.

Therefore, FIG. 10 illustrates a structure in which the diagonal tension member 150 is connected to the first buckling prevention member cradling portion 131, but the present disclosure is not necessarily limited thereto, and the diagonal tension member 150 may be directly connected to the mast portion 110 or the like as illustrated in FIG. 2 and FIG. 5.

Accordingly, in the transmission tower 100 according to an embodiment of the present disclosure, it is preferred to directly connect the diagonal tension member 150 to the mast portion 110 or to match the second buckling prevention member 141 with the working point of the diagonal tension member 150. In such a case, the buckling prevention member 140 may play the role of supplementing the vertical stability of the arm member 120 and the first buckling prevention member cradling portion 131 instead of transferring load from the diagonal tension member 150.

In addition, the angle of installation of the diagonal tension member 150 has a significant influence on the resistance characteristics of the diagonal tension member 150, and it is thus preferred to calculate the angle of installation of the diagonal tension member 150 and the optimal position when installing the same.

Accordingly, although conventional transmission towers 100 have a large structure section loss because both a tensile force and a compressive force are applied to respective structures, the transmission tower 100 having an improved structure according to the present disclosure has compression members and tension members disposed separately, and has increased tension members such that less consideration of buckling is necessary. As a result, the size and amount of necessary members can be minimized, thereby substantially reducing costs for fabrication, transportation, construction, and the like.

In addition, in the case of a conventional transmission tower 100, close observation on the field may be necessary to assess whether the same is abnormal or not. In contrast, the transmission tower 100 having an improved structure according to the present disclosure has major tension members all disposed redundantly such that, even if one member is broken, the damage can be easily assessed while the overall stability is maintained, thereby facilitating maintenance, repair, and management.

Moreover, members need to be piled one after another to assemble a conventional transmission tower 100, thereby requiring a long construction time, and the lifting length increases in proportion to the height of construction site, thereby increasing the difficulty in construction. In contrast, the transmission tower 100 having an improved structure according to the present disclosure may have a substantially increased amount of assembly work on the ground, thereby reducing difficulty in construction, and effectively shortening the construction time.

The technical idea of the present disclosure has been described above with reference to examples, and various changes and modifications could be made by those skilled in the art to which the present disclosure pertains without deviating from the essential features of the present disclosure. Therefore, embodiments described in the present disclosure are not intended to limit the technical idea of the present disclosure but to describe the same, and is not limited by such embodiments. The scope of protection of the present disclosure is to be interpreted by the appended claims, and all technical ideas falling within equivalent ranges are to be interpreted as being included in the scope of right of the present disclosure.

The invention claimed is:

1. A transmission tower comprising:

a mast portion erected on the ground;

at least one arm member, in a linear shape, provided perpendicularly to the longitudinal direction of the mast portion so as to cradle a transmission line;

multiple first buckling prevention member cradling portions provided along the longitudinal direction of the mast portion; and multiple buckling prevention members provided to extend from a lower end of the mast portion to the upper end of the mast portion via the multiple first buckling prevention member cradling portions so as to prevent the mast portion from buckling, wherein the multiple buckling prevention members are provided in a linear shape between the multiple first buckling prevention member cradling portions.

2. The transmission tower of claim 1, further comprising at least one arm member connecting portion configured to connect the multiple first buckling prevention member cradling portions and the at least one arm member.

3. The transmission tower of claim 2, wherein the at least one arm member connecting portion comprises:

an upper arm member connecting portion configured to connect the at least one arm member and at least one of the first buckling prevention member cradling portions positioned above the at least one arm member; and a lower arm member connecting portion configured to connect the at least one arm member and at least one other of the first buckling prevention member cradling portions positioned below the at least one arm member.

4. The transmission tower of claim 2, wherein the at least one arm member connecting portion comprises multiple wire rods connected from the at least one arm member to the multiple first buckling prevention member cradling portion in symmetric shapes while having a predetermined inclination with regard to each other.

5. The transmission tower of claim 1, wherein the multiple buckling prevention members are connected from the lower end of the mast portion to the upper end of the mast portion at an identical interval with regard to each other.

6. The transmission tower of claim 1, wherein the multiple buckling prevention members further comprise at least one second buckling prevention member connected from the multiple first buckling prevention member cradling portion to the mast portion while having a predetermined inclination.

7. The transmission tower of claim 1, further comprising at least second buckling prevention member cradling portion positioned to be spaced apart from the at least one arm member by at least a predetermined distance therefrom and fixed to the mast portion in a linear shape.

8. The transmission tower of claim 1, further comprising multiple diagonal tension members fixed to the ground from the mast portion while having a predetermined inclination so as to prevent the mast portion from falling.

9. The transmission tower of claim 8, wherein the multiple diagonal tension members are fixed to the ground from the mast portion at an identical interval with each other.

10. The transmission tower of claim 9, wherein each of the diagonal tension members comprises multiple wire rods having a predetermined angle with each other.

* * * * *